United States Patent [19]

Tamaru et al.

[11] 4,272,836

[45] Jun. 9, 1981

[54] ALARM TIMEPIECE

[75] Inventors: Munetaka Tamaru; Minoru Natori, both of Tokyo; Sizuo Yamaguchi, Sayama, all of Japan

[73] Assignee: Citizen Watch Co., Ltd., Tokyo, Japan

[21] Appl. No.: 2,217

[22] Filed: Jan. 9, 1979

[30] Foreign Application Priority Data

Jan. 12, 1978 [JP] Japan ..... 53-2302
Jan. 14, 1978 [JP] Japan ..... 53-3085
Apr. 4, 1978 [JP] Japan ..... 53-39394

[51] Int. Cl.[3] ..... G04B 23/02; G04C 19/00

[52] U.S. Cl. ..... 368/74; 368/82; 368/261

[58] Field of Search ..... 58/21.11, 21.14, 126 R, 58/127 R, 38, 57.5, 19 A, 19 B, 16.5, 50 R, 85.5, 91; 368/72–74, 82–84, 250–251, 261

[56] References Cited

U.S. PATENT DOCUMENTS

| | | | |
|---|---|---|---|
| 3,834,153 | 9/1974 | Yoda et al. | 58/57.5 |
| 3,958,409 | 5/1976 | Manber | 58/50 R |
| 3,982,239 | 9/1976 | Sherr | 58/50R |
| 3,987,617 | 10/1976 | Slob | 58/50 R |
| 4,006,585 | 2/1977 | Tamaru et al. | 58/50 R |
| 4,040,248 | 8/1977 | Laesser | 58/57.5 |
| 4,077,032 | 2/1978 | Volkmann | 58/50 R |
| 4,115,993 | 9/1978 | Moriya | 58/21.11 |
| 4,122,660 | 10/1978 | Canavan | 58/16.5 |

*Primary Examiner*—Vit W. Miska

*Attorney, Agent, or Firm*—Birch, Stewart, Kolasch and Birch

[57] ABSTRACT

An alarm timepiece is disclosed in which a plurality of alarm times may be set and the set alarm times may be displayed. The timepiece includes a plurality of alarm time memory means, alarm time display means connected to the alarm time memory means and control means for controlling the input signal for the alarm time memory means. The alarm time display means are circumferentially arranged in same manner as the time index of the watch dial, whereby set alarm time may be indicated in the display means.

10 Claims, 14 Drawing Figures

ALARM TIMEPIECE

BACKGROUND OF THE INVENTION

The present invention relates to an alarm timepiece in which a plurality of alarm times may be set and the set alarm times may be displayed.

In some conventional alarm electronic watches at least two alarm buttons are provided and the buttons must be operated in various modes for setting a plurality of alarm times. In such alarm watches, alarm times are not displayed in the watch. In addition, it is difficult in practice to provide an alarm timepiece in which four or more alarm times may be set.

SUMMARY OF THE INVENTION

It is an object of the present invention to provide an alarm timepiece in which a plurality of alarm times may be set and may be displayed.

Further objects and features of the present invention will be apparent from the following description taken in conjunction with the accompanying drawings.

DETAILED DESCRIPTION OF THE PREFERRED EMBODIMENTS

Figure 3:
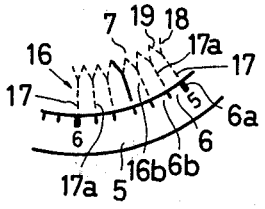
FIG. 3 is a plan view showing a part of alarm time display.

Referring to FIGS. 1 to 4 showing an alarm electronic wristwatch, a watch case 4 has a ring 5 secured to the inside thereof on which alarm time indexes 6 are provided by 12 hours at intervals corresponding 10 minutes. As shown in FIG. 3, the alarm time indexes comprises an hour index 6*a* and a 10-minute index 6*b*. The liquid crystal display device 7 has a month display 8, a date display 9, a day display 10, an hour display 11, an A.M. display 12, a P.M. display 13, a minute display 14 and a second display 15. In accordance with the present invention, a circumferentially arranged alarm time display 16 is provided in the liquid crystal display device 7. As shown in FIG. 3, the alarm time display 16 comprises radially arranged alarm time indicating lines and bifurcated lines 18 and 19 disposed at the inner end of the line. The alarm time indicating line comprises an hour line 17 for the hour index 6*a* and a minute line 17*a* for the 10-minute index 6*b*. Each line comprises the liquid crystal segments which are transparent in the non-operated state. The counter-clockwise side line 18 is to indicate A.M. and the clockwise side line 19 is to indicate P.M. The watch has a time correcting button 20, an alarm button 21, an alarm select push-button 22 and an alarm set push-button 23.

Figure 4:
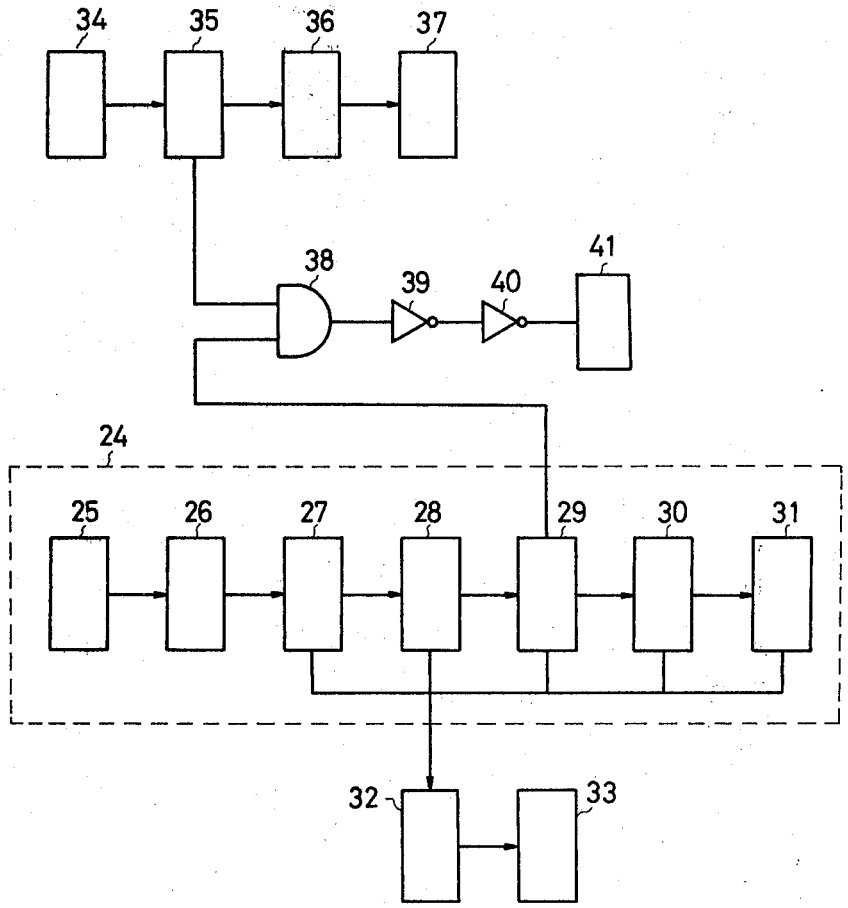
FIG. 4 is a block diagram of the alarm system of the wristwatch.

Referring to FIG. 4 showing the block diagram of the alarm system of the present invention, 24 is a time measurement system of the digital electronic watch which comprises a time standard signal generating means 25 of crystal oscilator, a frequency divider 26, a second counter 27, a minute counter 28, a 10-minute counter 29, an hour counter 30, and a calendar means 31. The watch further comprises a decoder 32 and a time display means 33 corresponding to the liquid crystal display device 7 in FIG. 1. In accordance with the present invention, an alarm control means 34, an alarm time memory means 35, alarm set time display control means 36 and alarm time display means 37 are provided. When the output of the 10-minute counter 29 coincides with the output of the alarm time memory means 35, gate 38 produces an output signal which actuates an alarm 41 through inverters 39 and 40.

In operation, to correct the time, the time correcting button 20 is pulled out and the push-button 22 is depressed, so that the hour display 11 is flashed. By repeatedly operating the push-button, the flashing of the display is sequentially shifted in such an order as the hour display 11, A.M. display 12, P.M. display 13, minute display 14, second display 15, month display 8, date display 9 and day display 10. When the desired display is flashed, correction of the display may be carried out by operating the push-button 23.

To set the alarm, the alarm button 21 is pulled out, whereby the alarm control system is turned to the alarm set enabling state. If the alarm select push-button 22 is depressed, the alarm control means 34 intermittently actuates the liquid crystal segments in one of the hour lines 17 to flash the line, so that the corresponding hour index 6*a*, for example, for 4 o'clock may be indicated. If the push-button 22 is released, the flashing of the line disappears. If the alarm select push-button 22 is depressed again, the next hour line 17 corresponding to the next hour index 6*a* is flashed to indicate the time, that is 5 o'clock. If the alarm set push-button 23 is depressed, the counter-clockwise (A.M.) side line 18 of the hour line 17 corresponding to 5 o'clock is flashed. After releasing of the push-button 23, if the push-button is depressed again, the counter-clockwise (P.M.) side line 18 disappears and the clockwise side line 19 is flashed. Further, if the push button 23 is operated, the whole display of 5 o'clock disappears and the next minute line 17*a* (FIG. 3) corresponding to 10 minutes past 5 o'clock is flashed and the A.M. side line 18 adjacent the line 17*a* is flashed. By operating further the push-button 23, the next P.M. side line 19 is flashed. Further, the repeating of operation of the push-button 23 causes the flashing of lines 17*b* and 18 corresponding 5:20 A.M. and flashing of the lines of 5:20 P.M. In order to set the alarm time, the alarm select push-button 22 is depressed under the depression of the alarm set push-button 23, so that the flashing of the lines 17*b* and 19 is changed to the continuous displaying state. Thus, the alarm time of 5:20 P.M. may be set.

Figure 1:
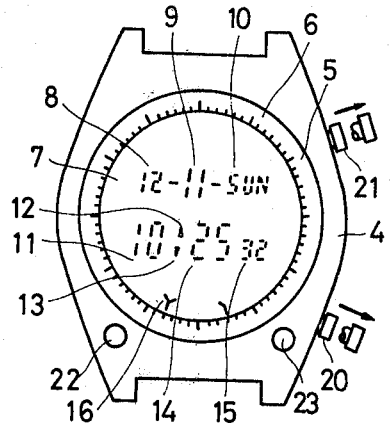
FIG. 1 is a plan view showing an alarm wristwatch in accordance with the present invention.
Figure 2:
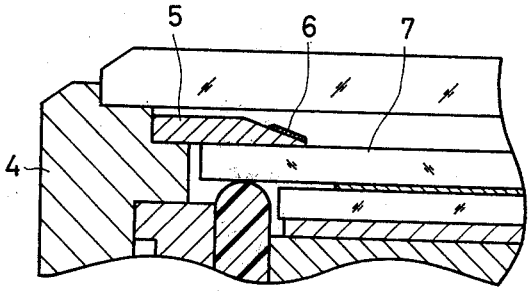
FIG. 2 is a sectional view showing a part of the wristwatch.

Thereafter, if the alarm select push-button 22 is operated, the line of 5 o'clock is flashed, and further operation effects the flashing of the line of 6 o'clock. Similarly, further operations of the push-button 22 causes the shifting of the flashing of the hour line 17. Thus, a plurality of alarm times may be set in the watch. FIG. 1 shows set alarm time indications of 5:20 P.M., 6:30 A.M., 6:30 P.M. and 9:00 A.M.

To reset the whole of the set alarm times, the alarm button 21 is pulled out and the alarm select push-button 22 is depressed for a predetermined time, for example 5 minutes. When the set alarm times are reset, the displays of the alarm disappear. To reset one of the set alarm times, the alarm button 21 is pulled out and the alarm select push-button 22 is operated in the manner as described about the set of alarm time to flash the line 17 corresponding the time to be reset. Then, the push-buttons 22 and 23 are depressed for a predetermined time.

Figure 5:
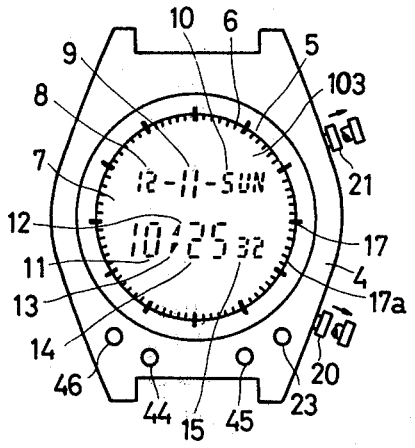
FIG. 5 is a plan view showing another embodiment of the present invention.

Referring to FIG. 5 showing another embodiment of the present invention, the alarm electronic wrist watch has an alarm reset push-button 45, an alarm hour select push-button 46 and an alarm minute select push-button 44. Other parts are same as the previous embodiment and therefore same numerals as previous one are used to identify the parts.

To select the hour in the alarm time, the alarm button 21 is pulled out and the hour select push-button 46 is operated. The flashing display on the hour line 17 is shifted at every operating of the push-button 46. When the hour display on the line reaches to the hour line corresponding to the alarm time, the alarm set button 23 is depressed while holding the push-button 46 in the depressed position. Thus, the hour in the alarm time may be set and the display is held in the continuous indicating state. To set the minute in the alarm time, the alarm minute select push-button 44 is operated. If the push-button is depressed, the A.M. side line of the flashing hour line is flashed and if the push-button is further operated, the next minute line 17*a* and the A.M. side line are actuated to flash. By repeating the operation of the push-button 44 flashing of the line is shifted as described above. When the desired minute line and A.M. or P.M. side line are flashed, the alarm set push-button is pushed to thereby stop the flashing. If the alarm set push-button 23 is depressed, the alarm time is set and the flashing of the line is changed to continuous displaying state. If the alarm button 21 is depressed, each alarm push-button may not be operated.

To reset all the alarm times, the alarm button 21 is pulled out and the reset push-button 45 is depressed. To reset one of the set times, after flashing the set time, line, the alarm set push-button 23 and hour select push-button 46 are depressed for a predetermined time.

Figure 6A:
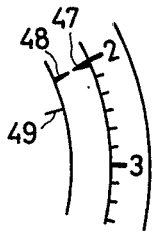
FIGS. 6*a* and 6*b* are plan views showing other examples of the alarm time display.
Figure 6B:
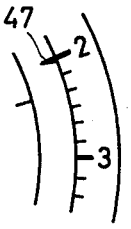

FIGS. 6*a* and 6*b* show another alarm set display mode. In the display device, A.M. display line 47, P.M. display line 48 and alarm time line 49 are provided. FIG. 6*a* shows the set alarm time of 2:20 A.M. and 2:20 P.M. and FIG. 6*b* shows the set alarm time 2:20 A.M.

Figure 7:
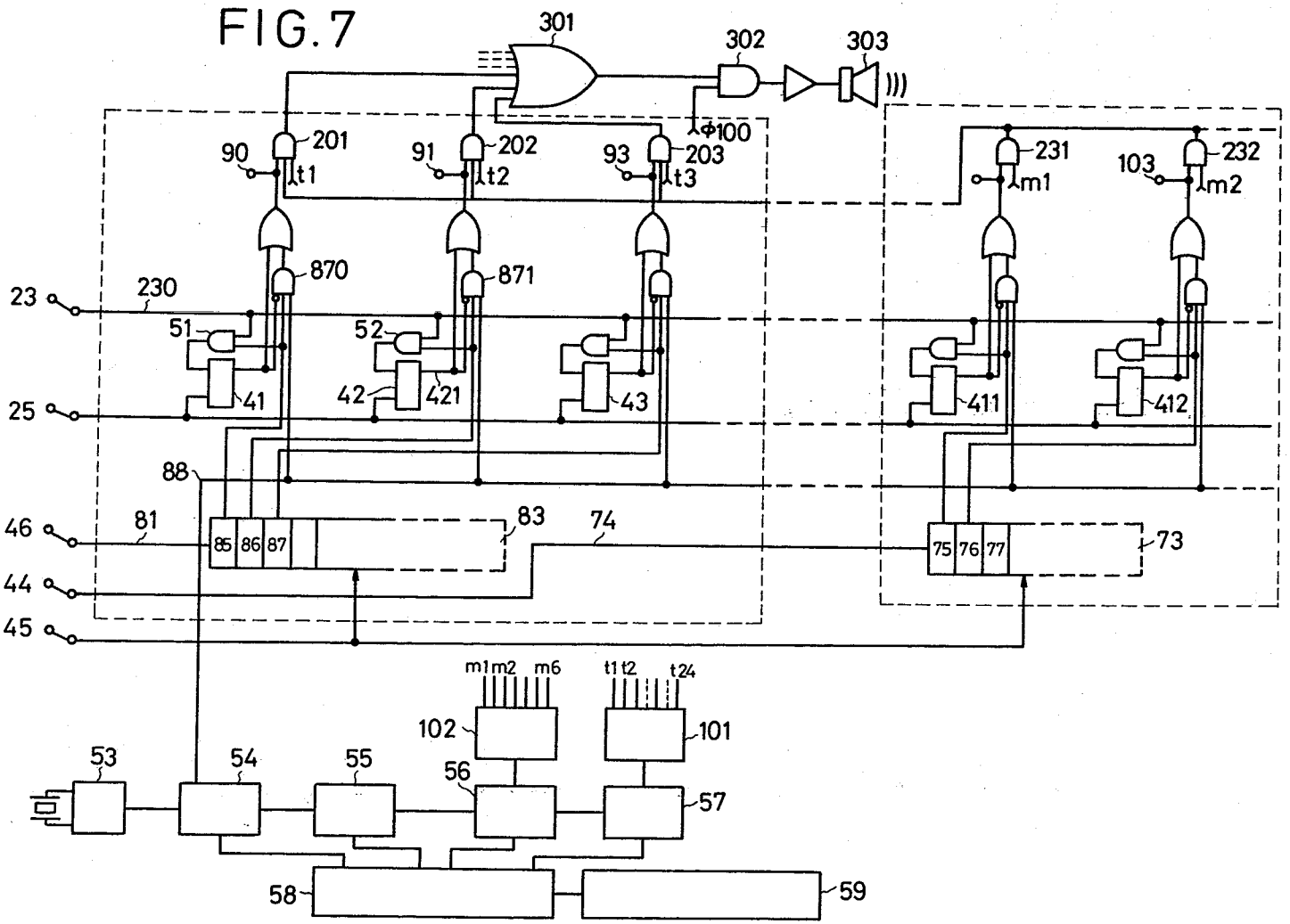
FIG. 7 is a block diagram of the system of the embodiment.

Referring to FIG. 7 showing a circuit of the embodiment of FIG. 5, there is provided an electronic watch system comprising a quartz crystal oscilator 53, a frequency divider 54, a second counter 55, a minute counter 56, an hour counter 57, a decoder 58 and a display 59. If the alarm hour select push-button 46 is depressed, potential on a line 81 becomes high level (hereinafter called as H) to thereby actuate a shift register 83. The shift register comprises 24 pieces of flip-flop for setting alarm times of 24 hours. When the output of a flip-flop 83 becomes H, an AND gate 870 is actuated to produce the flashing signal in accordance with the pulse signal on a line 88 from the frequency divider 54, whereby an hour line 90 of 1 o'clock corresponding to the hour line 17 in FIG. 5 is flashed. If the push-button 46 is further operated, the output of a flip-flop 86 goes to H to flash an hour line 91 of 2 o'clock and the display of the hour line 90 of 1 o'clock disappears. To set the alarm time of 2 o'clock level, the push button 23 is depressed so that the potential on a line 230 becomes H. Thus, an AND gate 52 is actuated to produce an output to set a flip-flop 42, whereby the output 421 goes to H. Accordingly, the AND gate 871 is actuated by the output 421 of H to change the flashing signal output to the continuous signal, so that the hour line 91 becomes continuous display state. Further, by operating the buttons 46 and 23 in the same manner as described above, other alarm times may be set. It will be seen that the hour line 91 is held in the continuous display state by the output of the flip flop 42 irrespective of setting of another alarm time.

To set the minute of the alarm time, for example to set the alarm time of 2:20, the push-button 44 is depressed to actuate a shift register 73. The shift register 73 comprises 6 pieces of flip-flop for setting the minute of the alarm time. By operating the push-button 44, the flashing of the minute line 17*a* in FIG. 5 is shifted. When the output of a flip-flop 76 becomes H, the minute line 103 of 2:20 (FIG. 5) is flashed. At that time, the button 23 is depressed to set a flip-flop 412, so that the minute line 103 is changed to the continuous display state. This shows that the alarm time of 2:20 is set. When all alarm times are set, the reset push-button 45 is depressed to reset the shift registers 83 and 73.

An hour detecting means 101 is adapted to produce the hour signal on each of outputs $t_1$ to $t_{24}$ which is inputted to each of AND gates 201 to 224. A 10-minute detecting means 102 is provided to produce the 10-minute signal on each of outputs $m_1$ to $m_6$ which is inputted to each of AND gates 231 to 236. When the 10-minute signal $m_2$ of 20 minutes is applied to the AND gate 232 and the hour signal $t_2$ of 2 o'clock is applied to the AND gate 202, the AND gate 202 produces the alarm signal output. The alarm signal is applied to an AND gate 302 through an OR gate 301, so that a buzzer signal $\phi$ 100 is applied to a buzzer 303 to make an alarm noise. Such alarm operation takes place at the every alarm time set in the watch.

It will be understood that the present invention may be applied to the analogue watch. The alarm time index 6 and the alarm time display 16 in the illustrated embodiments may be modified to various modes and other optical display device such as the light emitting diode or the lamp may be employed, and the alarm time index may be provided on the watch case, glass, or glass of the liquid crystal display.

Figure 8:
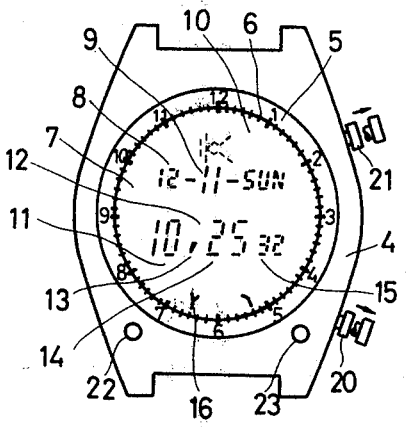
FIG. 8 is a plan view showing a further embodiment of the present invention.
Figure 9:
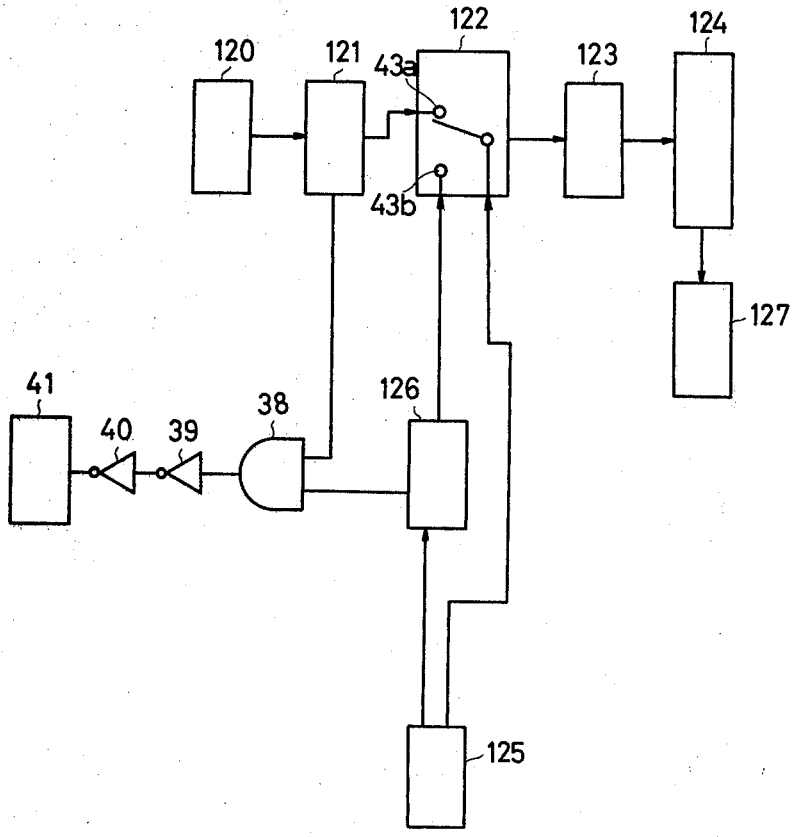
FIG. 9 is a block diagram of the system of the embodiment.

Referring to FIGS. 8 and 9 showing another embodiment of the present invention, display pattern of the time and alarm time is similar to the previous embodiment described with reference to FIGS. 1 to 4.

Referring to FIG. 9 showing the block diagram of the digital electronic watch of the embodiment, the system comprises a time standard signal generating means 120, a frequency divider 121 for producing the time signal and minute signal, a switching means 122, a decoder 123 and a display means 124. In accordance with the embodiment, an alarm control means 125, an alarm time memory means 126, and set alarm time display control means 127 are provided. When the output of the frequency divider 121 coincides with the output of the alarm time memory means 126, gate 38 produces an output signal which actuates an alarm 41 through inverters 39 and 40 as described about the previous embodiment.

To set the alarm, the alarm button 21 is pulled out, whereby the alarm control means 125 is operated to actuate the switching means 122 to change over. As a result, displays in the hour display 11 and minute display 14 becomes "00" and other displays except the A.M. and P.M. displays disappear. If the alarm select push-button 22 is depressed, the alarm control means 125 intermittently actuates the liquid crystal segments in each display of the display means 124 to flash. By repeatedly operating the push-button 22, the flashing of the display is shifted in such an order as the A.M. display 12, P.M. display 13, hour display 11, minute display 14. When a desired display is flashed, the set push-button 23 is depressed. The hour and minute are respectively displayed in the hour display 11 and the minute display 14 by the operation of the push-button 23 and each display advances as the operating of the button. When the flashing display reaches to the alarm time, the select button 22 is depressed to thereby set the alarm time. Further, if the set push-button 23 is depressed in the depressed state of the push-button 22, the alarm time is memorized in the memory means 126. At the same time, the hour display 11 and the minute display 14 return to "00" and the set alarm time display control means 127 is actuated to display the memorized alarm time in the alarm time display 16 as is in the previous embodiment. After setting of the alarm time, the alarm button 21 is depressed. Reset of the alarm time may be performed by a similar manner to the previous embodiment.

Figure 10:
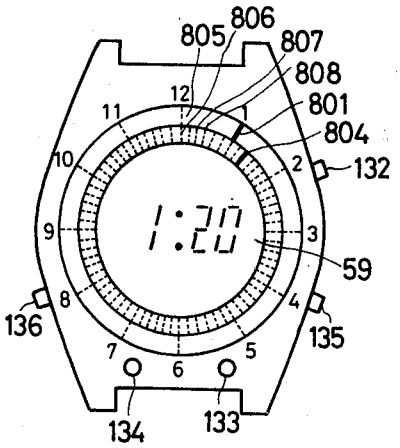
FIG. 10 is a plan view of a still further embodiment of the present invention.
Figure 11:
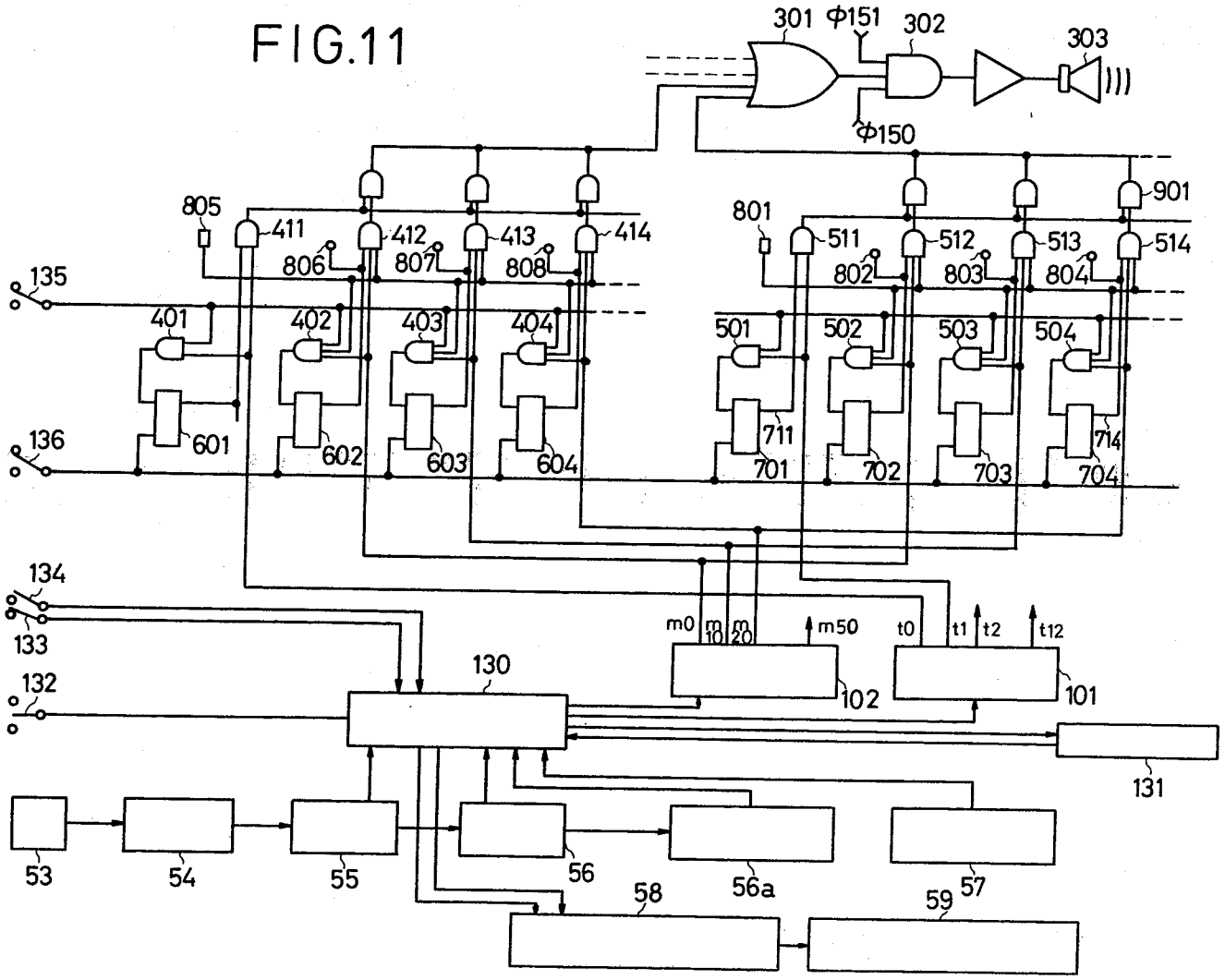
FIG. 11 is a block diagram of the system of the embodiment.

Referring to FIGS. 10 and 11 showing a further embodiment of the present invention, the system has same means as the system of FIG. 7 and therefore same numerals are used to identify the same part. The system is further provided with a 10-minute counting means **56*a*, a control circuit 130, and an alarm time setting circuit 131**.

When a change-over switch 132 is turned on, an alarm time signal memorized in the alarm time setting circuit 131 is applied to the display 59, whereby the memorized time is displayed. Further, the 10-minute detecting means 102 and the hour detecting means 101 are turned to the state for detecting the memorized content in the alarm time setting circuit 131. By operating a figure select switch 133 and a correcting switch 134, alarm time may be set in the alarm time setting circuit. For example, in order to set the alarm time of 1:20, the figure of hour is selected by operation of the figure select switch 133 and 1 o'clock is set by operating the correcting switch 134 indicated in the display 59. Further, the figure of minute is selected by the figure select switch 133 and 20 minute is set by the correcting switch 134. in such a state, the hour detecting means 101 produces an output of $t_1$ which is applied to AND gates 501 and 511 and the 10-minute detecting means 102 produces an output of $m_{20}$ which is applied to AND gates 514 and 504. Thus, if a set switch 135 is turned on, the AND gates 501 and 504 produce an output to set flip-flops 701 and 704 respectively, whereby outputs appear on leads 711 and 714 to actuate liquid crystal segments 801 and 804 respectively. It will be seen that the liquid crystal segment 801 is to indicate 1 o'clock and the segment 804 is for 20 minutes as shown in FIG. 10 and that FIG. 10 shows the set alarm time of 1:20.

The output $m_{20}$ for indicating 20 minutes is further applied to an AND gate 404. However, since a liquid crystal segment 805 for indicating 12 o'clock (FIG. 10) is not actuated, a flip-flop 604 is not actuated. Accordingly, a liquid crystal segment 808 is not actuated. Other alarm times may be set in the same manner as the set of above example. After the setting of necessary alarm times, the change over switch 132 is turned off, whereby time display system starts to operate. When outputs of the 10-minute counting circuit **56*a* and hour counting circuit 56 coincide with the set alarm time, for example, when the set alarm time of 1:20 is detected, the output of $t_1$ and $m_{20}$ are produced from the detecting means 101 and 102. Thus, AND gate 901 operates to produce an output which is applied to the buzzer 303 through the gates 301 and 302 to generate an alarm. By operating a switch 136**, the alarm may be reset.

Figure 12:
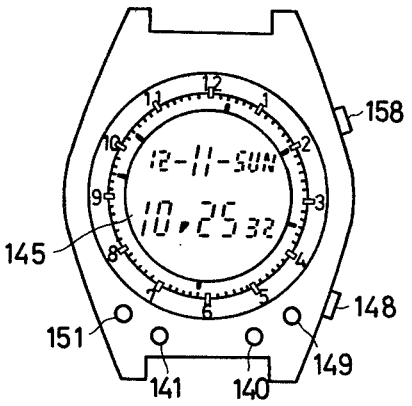
FIG. 12 is a plan view showing a further embodiment of the present invention.
Figure 13:
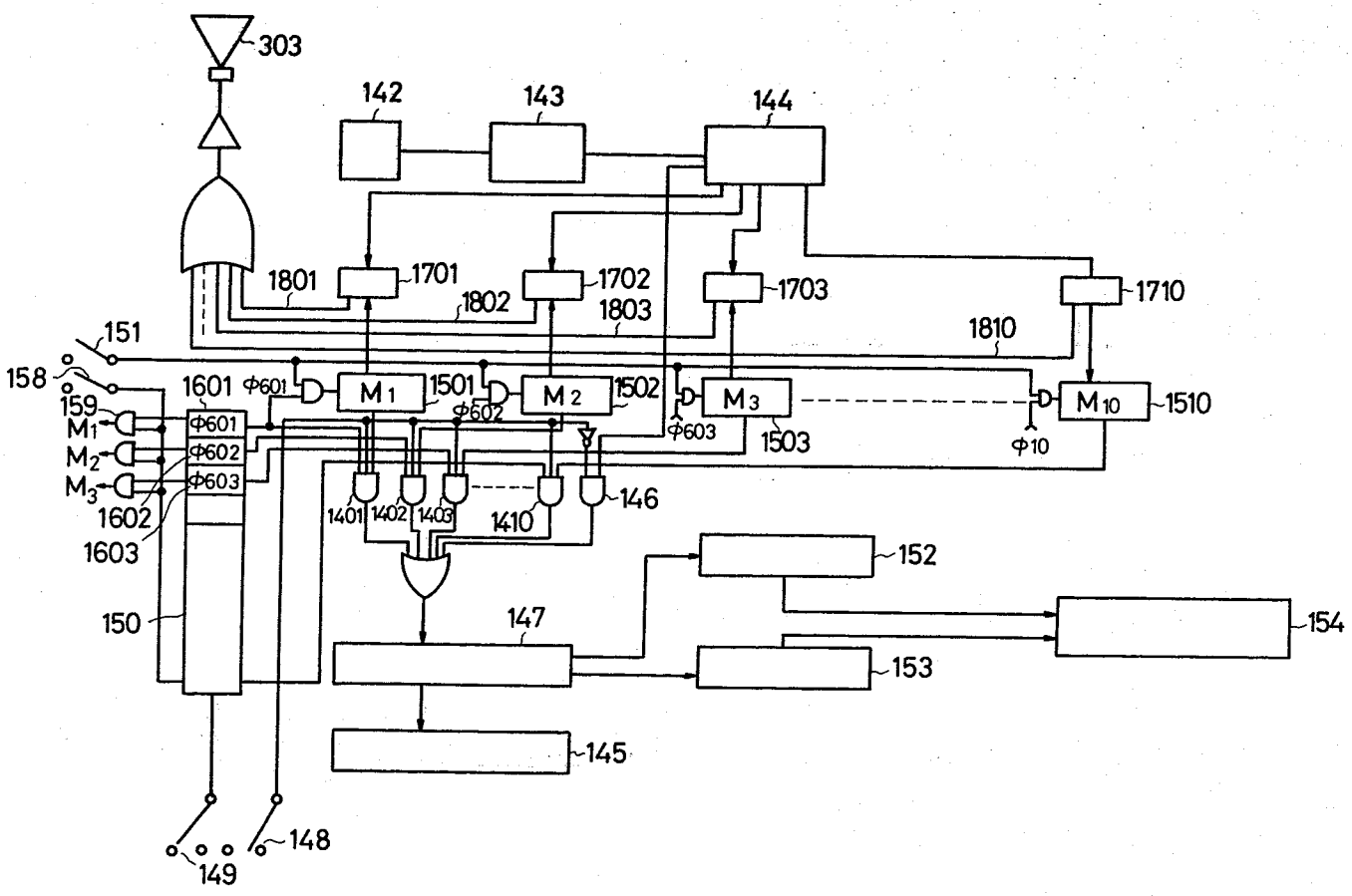
FIG. 13 is a block diagram showing the system of the embodiment.

Referring to FIGS. 12 and 13 showing further embodiment of the present invention, alarm time display pattern of this embodiment is similar to that of FIG. 10. Alarm times set in the watch shown in FIG. 12 are levels of 12:20, 2:00, 3:30, 6:10, 9:30 and 10:20.

FIG. 13 shows a block diagram of the system, 142 is an oscilator, 143 is a frequency divider, and 144 is a counter. Output of the counter 144 is applied to a digital display device 145 through a gate 146 and a decoder 147 producing the time display. To set the alarm time, switch 148 is closed to thereby actuate the AND gate 146 to inhibit the output of the counter 144 from appearing on the output of the gate, and switch 149 is closed to actuate a shift register 150. By repeatedly operating the switch 149, flip-flops 1601, 1602, 1603 . . . operates sequentially to produce the sequential output of high level, whereby AND gates 1401, 1402 . . . 1410 are sequentially operated. Thus, information memorized in memory means 1501, 1502, 1503 . . . 1510 are inputted in the decoder 147 through the AND gates 1401 to 1410 to thereby display the information in the digital display device 145. Information in the memory means 1501 to 1510 may be corrected by operating a switch 151.

Figure 14:
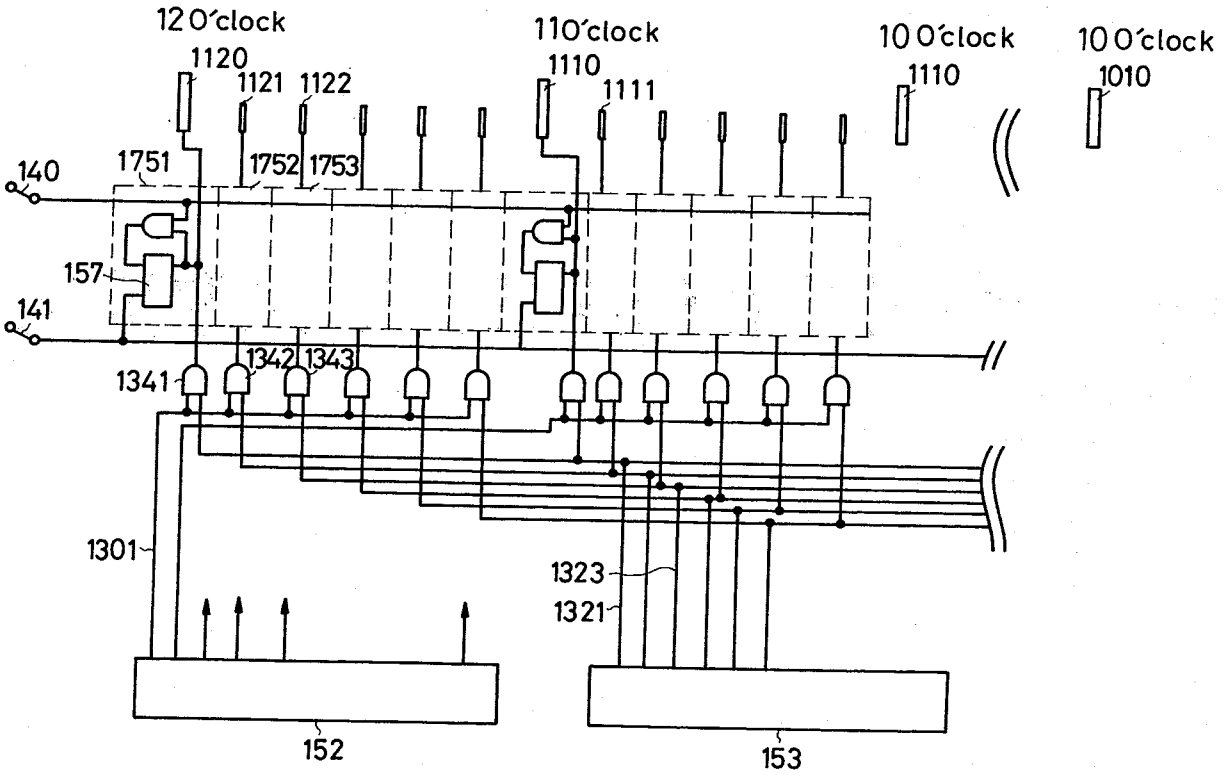
FIG. 14 is a block diagram showing the system for displaying the alarm times.

On the other hand, the information in the memory means is detected by an hour detecting means 152 and a 10-minute detecting means 153 and displayed in an alarm time display means 154. FIG. 14 shows the alarm time display means. The means has hour lines 1120, 1110, 1100 . . . 1010 and 10-minute lines 1121, 1122 . . . .

If the information in the memory means 1501 is 12:25, the hour detecting means 152 detects 12 o'clock signal to produce the output on a line 1301 and the 10-minute detecting means 153 detects 20 minutes to generate the output on a line 1323. Accordingly, an AND gate 1343 is actuated to produce an output to actuate a lighting circuit 1353, whereby the line 1122 of 12:20 is lighted. The lighting circuit 1753 is same as a lighting circuit 1751. If a set push-button 140 is depressed to turn on, a flip-flop 157 is operated to be set. Therefore, if the output from the AND gate 1341 disappears, the line 1120 is held in lighting state. By repeatedly operating the switch 151, the information in the memory means 1501 is changed with displaying the information in the digital display device 145 and in the alarm time display means 154, that is in the lines 1120, 1121 . . . . When the display in the digital display device 145 reaches to a desired alarm time, the set push-button 140 is depressed, whereby the lighting of the alarm time may be maintained.

By further operating the switch 149, the flip-flop 1602 of the shift register 150 produces the output of high level, so that the AND gate 1402 is actuated to produce an output. Thus, information in the next memory means 1502 is displayed in the display device 145 and the alarm time display means 154. Information in the memory means 1502 may be set in the same manner as above mentioned operation. When setting of all alarm times are finished, the switch 148 is opened to reset the shift register 150 and measured time signal from the counter 144 is displayed in the display device 145. Each of equality checking circuits 1701 to 1710 compares the time signal from the counter 144 with the alarm time signal from each of the memory means 1501 to 1510. When both signals coincides with each other, an output is generated on one of leads 1801 to 1810 to actuate the buzzer 303.

To stop the alarm, a reset push-button 141 is depressed. In order to reset the unnecessary information, by operating the switch 149 and a switch 158, the information of the corresponding memory means may be reset. For example, the output signal of the flip-flop 1601 and the signal from the switch 158 actuate an AND gate 159 to produce an output for reset of the memory means 1501.

We claim:

1. An alarm timepiece comprising:

time measurement means for calculating the actual time of day;

time display means for displaying the actual time of day calculated by said time measurement means;

alarm memory means for storing a plurality of alarm times;

alarm display means for simultaneously displaying said plurality of alarm times, said alarm display means including a plurality of alarm display devices circumferentially arranged around said time display means and an index means for selectively addressing one of said plurality of alarm display devices, said alarm display means providing a continuous display of said plurality of alarm times;

alarm control means for independently setting and resetting said plurality of alarm times;

comparator means for comparing the actual time of day with each of said plurality of alarm times and producing a coincident signal when one of said plurality of alarm times equals said actual time of day; and alarm means responsive to said coincident signal.

2. An alarm timepiece according to claim 1 in which said time measurement means includes an oscilator, a frequency divider and a counting means, and said time display means comprises a decoder and an electro-optical display device.

3. An alarm timepiece according to claim 1 wherein each of said electrical display devices is a liquid crystal display device.

4. An alarm timepiece according to claim 1 wherein said alarm control means includes a shift register for sequentially operating said alarm memory means.

5. An alarm timepiece according to claim 4 wherein said alarm memory means includes hour memory means and minute memory means and said shift register includes a shift register for the hour memory means and a shift register for the minute memory means.

6. An alarm timepiece according to claim 1 wherein said alarm display means includes means for displaying A.M. and P.M. information.

7. An alarm timepiece according to claim 6 wherein said means for displaying A.M. and P.M. have different locations.

8. An alarm timepiece according to claim 1 wherein said alarm control means includes a switching means for connecting the output of said alarm memory means to said time display means.

9. An alarm timepiece according to claim 1 wherein said alarm memory means and said alarm display means are connected to said decoder, whereby each of said alarm times may be displayed on said time display means and said alarm display means.

10. An alarm display system for an electric timepiece having a actual time of day display, said display system comprising:

storage means for storing a plurality of alarm times;

a plurality of alarm display devices circumferentially arranged around the time of day display, said alarm display devices simultaneously and continuously indicating said plurality of alarm times stored in said storage means; and alarm control means for independently and selectively setting or resetting each of said alarm times stored in said storage means.

* * * * *